US007530141B2

(12) United States Patent
Heinrichs et al.

(10) Patent No.: US 7,530,141 B2
(45) Date of Patent: May 12, 2009

(54) DOOR ARRESTER

(75) Inventors: Gundolf Heinrichs, Remscheid (DE); Peter Hoffmann, Overath (DE); Ute Krueger, Remscheid (DE)

(73) Assignee: Edscha AG, Remscheid (DE)

( * ) Notice: Subject to any disclaimer, the term of this patent is extended or adjusted under 35 U.S.C. 154(b) by 228 days.

(21) Appl. No.: 10/542,510

(22) PCT Filed: Jan. 20, 2004

(86) PCT No.: PCT/DE2004/000074

§ 371 (c)(1),
(2), (4) Date: Jul. 20, 2005

(87) PCT Pub. No.: WO2004/065736

PCT Pub. Date: Aug. 5, 2004

(65) Prior Publication Data

US 2006/0059657 A1 Mar. 23, 2006

(30) Foreign Application Priority Data

Jan. 22, 2003 (DE) ..... 103 02 552

(51) Int. Cl.
*E05C 17/22* (2006.01)

(52) U.S. Cl. ..... 16/86 C

(58) Field of Classification Search ..... 16/86 C, 16/85, 86 R, 82, 255, 286, 333, 334; 296/146.11, 296/146.12; 292/262, 265, 266, 267, 278, 292/DIG. 15, DIG. 17
See application file for complete search history.

(56) References Cited

U.S. PATENT DOCUMENTS 1,393,032 A 10/1921 McFeggans ..... 292/262
2,716,256 A 8/1955 Wise ..... 16/86 R
4,788,743 A * 12/1988 Okumura ..... 16/82
5,173,991 A 12/1992 Carswell ..... 16/86
5,474,344 A * 12/1995 Lee ..... 292/262
6,446,305 B1 9/2002 Kneeland ..... 16/82
6,813,811 B2 * 11/2004 Matsuki et al. ..... 16/86 B
6,842,943 B2 1/2005 Hoffmann et al. ..... 16/82
6,901,630 B2 * 6/2005 Liang et al. ..... 16/82

(Continued)

FOREIGN PATENT DOCUMENTS

CA 1338152 3/1996

(Continued)

*Primary Examiner*—Chuck Y. Mah
(74) *Attorney, Agent, or Firm*—Davidson, Davidson & Kappel, LLC

(57) ABSTRACT

A door arrester is provided which comprises a housing (2), fastened on either the door or the door frame, a retaining rod (24), extending through an opening (23) in the housing (2) and fastened on the respective other part of door and door frame so as to be pivoted, at least one brake member (14) pretensioned in the direction towards the retaining rod (24) and having a peripheral surface (16) that is received in the housing (2) so as to be axially displaceable, and at least two fastening bores (9) oriented at an angle to the locating plane of the housing (2). An aim of the invention is to improve the generic door arrester so that it reliably and securely holds the door while being inexpensive to produce. For this purpose, one fastening bore (9) each is disposed on both sides of the principle planes which are perpendicular to the locating plane of the housing (2).

47 Claims, 5 Drawing Sheets

U.S. PATENT DOCUMENTS

| | | | | |
|---|---|---|---|---|
| 2003/0159243 | A1* | 8/2003 | Audisio | 16/82 |
| 2006/0267353 | A1* | 11/2006 | Van Den Heuvel | 292/262 |

FOREIGN PATENT DOCUMENTS

| | | | |
|---|---|---|---|
| DE | 18 08 783 | | 6/1970 |
| DE | 196 22 110 | | 2/1977 |
| DE | 27 02 731 | | 7/1978 |
| DE | 40 10 466 | | 10/1991 |
| DE | 4325550 | A1 * | 10/1994 |
| DE | 197 45 928 | | 4/1996 |
| DE | 296 06 304 | | 8/1996 |
| DE | 296 17 518 | | 12/1996 |
| DE | 196 32 630 | | 2/1998 |
| DE | 100 25 185 | | 11/2001 |
| DE | 201 20 271 | | 4/2002 |
| DE | 100 62 275 | | 7/2002 |
| EP | 1 070 188 | | 1/2001 |
| EP | 0 824 176 | B1 | 6/2003 |
| EP | 0 805 251 | | 7/2005 |
| FR | 770 550 | | 9/1934 |
| FR | 2 666 616 | | 3/1992 |
| GB | 154010 | | 11/1920 |
| GB | 526042 | | 9/1940 |
| GB | 833 844 | | 5/1960 |
| GB | 840 603 | | 7/1960 |
| GB | 1 568 326 | | 5/1980 |
| GB | 22 58 886 | | 2/1993 |
| WO | WO 99 53 164 | | 10/1999 |
| WO | WO 01/90 518 | | 11/2001 |

* cited by examiner

DOOR ARRESTER

FIELD OF THE INVENTION

The invention relates to a door arrester.

BACKGROUND

FR 2 666 616 A1 shows a door arrester for a motor vehicle, which comprises a housing, the housing having a first housing half and a second housing half. The two housing halves define an opening, with the first housing half and the second housing half in each case bounding just one section of the circumference of the opening. The opening is passed through by a retaining rod which is arranged pivotably on a door assembly part, the retaining rod being formed from two metallic, elastic blades which are connected to each other at their outer ends, and which, in a central region, form a cavity for the retaining rod. In each of the two housing halves are formed two cylindrical recesses in which two guide rollers are mounted exclusively rotatably, the guide rollers being arranged in the cavity of the retaining rod, and one of the guide rollers in each case being in contact with a respective flat side of one of the two blades. Two further, exclusively rotatable guide rollers are provided in the housing and are aligned perpendicularly with respect to the guide rollers, and are in contact with thin, outer flat sides of the two blades. The two blades have a wave-shaped profile which is symmetrical with respect to an axis of extent, with the axis simultaneously being the axis of symmetry of the housing. The two guide rollers can be secured in the wave troughs and define preferred latching positions of the arrester. A drawback of this type of door arrester is the fact that the retaining rod comprises two blades forming a cavity, thus resulting in slight deformability of the retaining rod due to frequent use of the door, for example. In the event of deformation of one of the two blades, or else of both of them, the wave profile is deformed asymmetrically and the defined latching positions are displaced or disappear, so that it is no longer certain or even no longer possible that the door will be immobilized. A further drawback is that the guide rollers bring about both the immobilization and the guiding of the retaining rods, with the result that, on the one hand, there has to be a relatively high frictional contact between the guide rollers and the blades for the immobilization and, on the other hand, for the easy movement of the door, a sliding of the guide rollers on the blades has to be realized, thus necessitating a compromise to the disadvantage of the immobilization or to the movement of the door.

U.S. Pat. No. 6,446,305 B1 shows a door arrester which comprises a single-part housing which has an opening, the opening being passed through by a retaining rod. The housing is fastened on the door or door frame by means of screws or rivets, and two brake members which in each case comprise a guide and a spring element are arranged in the housing, the spring element prestressing the guide counter to the retaining rod. Each of the two guides has a contact part which is in engagement with the retaining rod and which is formed in such a manner that the contact surface of the contact part forms a line with the retaining rod. The retaining rod is arranged between the two contact surfaces and its wide sides are in engagement with the two contact parts of the brake members. The wide sides of the retaining rod have a rising ramp, with the result that, during the opening of the door, because of the rising of the ramp counter to the two spring elements, the brake members have to overcome a force, and thus the opening movement of the door is inhibited. The ramp of the retaining rod also has a drop, so that the movement of the door is also inhibited during the closing movement thereof. The single-part design of the housing of the door arrester results in a complicated assembly, and the attachment of the door arrester to the door or the door frame is complex, since, after the retaining rod is placed into the housing, the brake members have to be arranged around the retaining rod and at the same time within the housing.

U.S. Pat. No. 5,173,991 A shows a door arrester which comprises a housing and a cover covering the housing. The housing and the cover each have an opening which are aligned with respect to each other. The housing and the cover are fastened on the door or the door frame by means of two screws. The two openings are passed through by a retaining rod which has an upper and a lower flat side, with each of the two flat sides having a groove in the direction of extent of the retaining rod. Recesses in which a respective brake member can be secured are provided in the two grooves. Each of the two brake members comprises a ball, which is in contact with the groove of the retaining rod, and a plastic element, which is prestressed in the direction of the retaining rod by a spring element and in which the ball is mounted on the side facing away from the spring element. During an opening or closing movement of the door, the retaining rod is guided by the housing, and the balls of the two brake members are carried along in the groove, with the recesses of the groove constituting latching positions for the movement of the door. A drawback of this type of door arrester is the fact that the assembly of the door arrester is complex, since first of all the two brake members have to be arranged around the retaining rod, and then the retaining rod and the two brake members have to be guided simultaneously into the housing in order subsequently to be able to close the housing with the cover.

WO 01 90 518 A11 shows a door arrester, in which a housing of integral design is passed through in an opening by a retaining rod, with two axially displaceable brake members being provided in the housing, which brake members are prestressed in the direction of the retaining rod by a respective compression spring and have spherical engagement domes on a side facing the retaining rod, the engagement domes being in contact with the retaining rod. The retaining rod is arranged between the engagement domes of the two brake members, the retaining rod having latching marks of round design matching the spherical engagement domes. Provided in the housing are two holes for fastening the housing to a motor vehicle by means of screws. The two holes are at the same distance from the retaining rod, the holes being arranged between the plane of displacement of the brake members and a fastening plane of the housing to the motor vehicle. A drawback of this type of door arrester is that the engagement domes of the brake members are of spherical design, so that the latching marks arranged on the retaining rod have to be of relatively large design, with the result that only a limited number of latching positions are possible and also the specific retaining force is limited. A further drawback is that the holes are arranged between the motor vehicle and the plane of displacement of the brake members, thus resulting in a relatively large overall height for the housing and, moreover, the forces exerted on the retaining rod by the brake members exert large moments, in particular on the screws for fastening the housing, because of the distance from the bearing plane of the housing on the corresponding door assembly part. Furthermore, the attachment of the door arrester to the motor vehicle is complex, since first of all the two brake members are placed into the housing, then the retaining rod has to be guided through the opening and, counter to the prestressing force of the two compression springs, through the housing in order finally to be screwed on the motor vehicle.

SUMMARY OF THE INVENTION

It is the object of the invention to provide a door arrester which makes reliable and secure immobilization possible and can be produced cost-effectively.

In accordance with an embodiment of the present invention, a housing is provided which can be fastened on one of a door and a door frame. Also provided is a retaining rod which passes through an opening in the housing. The retaining rod can be fastened pivotably to the other of the door and the door frame (i.e., the housing can fastened to the door and the rod fastened to the door frame, or vice versa). At least one brake member is provided which is prestressed in the direction of the retaining rod and has a casing surface which is held in an axially displaceable manner in the housing. At least two fastening holes are aligned transversely with respect to a bearing plane of the housing, The effect achieved by designing a housing for a door arrester by means of two housing halves, the two housing halves being connectable to each other, is that the assembly of the housing with a retaining rod passing through an opening of the housing is simplified, in particular by virtue of the fact that each of the two housing halves bounds just one section of the opening, thus facilitating the insertion of the retaining rod.

In the case of a door arrester having two housing halves, the arrangement of a brake member prestressed in the direction of the retaining rod by a spring element in at least one of the two housing halves makes it possible for the force acting upon the retaining rod to be transmitted by the brake member to the retaining rod in the axial direction, thus making it possible for the retaining rod to be securely immobilized in the door arrester, and the door is therefore securely immobilized.

The immobilization of the retaining rod by the brake members preferably takes place along a wide side of the retaining rod, as a result of which a contact surface of the brake member with the retaining rod is correspondingly large, and the transmission of force from the brake member to the retaining rod is improved. The brake member is expediently arranged in a manner such that it can be adjusted perpendicularly with respect to an edge of the opening, so that the displacement of the brake member and contact between the brake member and the retaining rod take place in a straight line. As a result, a tilting of the brake member during the adjustment is furthermore avoided, so that the securing force acts directly on the retaining rod.

The brake member preferably has an engagement lug which runs transversely with respect to the direction of movement of the retaining rod and is designed as a bead, thus reducing the contact surface of the brake member with the retaining rod. The securing force is thereby simultaneously concentrated onto the smaller contact surface and reinforced, so that the immobilization of the retaining rod is ensured.

A respective brake member is preferably provided in each of the two housing halves, with each of the two brake members having an engagement lug. The two brake members are expediently inserted into the two housing halves with the engagement lugs facing each other. As a result, the retaining rod is acted upon by the two brake members on both sides with a retaining force for immobilization purposes, so that the retaining force acting on the retaining rod is increased. Furthermore, by acting upon the retaining rod on both sides, an undesired tilting in an immobilized position and/or during the movement is avoided. The spring element preferably comprises a compression spring which has a part which is arranged within the brake member, the brake member having a cavity. As a result, the compression spring is guided securely in the brake member, so that the compression spring can only experience an axial extension during the immobilizing of the retaining rod, and it is not possible for the compression spring to buckle in an undesired direction, with the result that the force acting on the brake member by the compression spring is directed toward the retaining rod.

In one preferred refinement, the opening of the housing is of smaller dimensions than both end regions of the retaining rod, so that the two housing halves can be connected by the retaining rod being fitted over. This makes it possible to match the opening of the housing to the size of the retaining rod. The size of the opening also at the same time determines the size of the two housing halves, which means that the two housing halves can also be designed in an advantageously compact manner, so that the door arrester has a compact design.

When the door is actuated, the two housing halves are acted upon by the retaining rod with a forced directed transversely with respect to the housing halves. In order to compensate for the transverse force, the two housing halves are preferably connected to each other by rivets, thus expediently stiffening the housing and strengthening the housing against the force. It is therefore possible for the two housing halves to be able to be manufactured from a lightweight material, for example plastic, since the force is compensated for by the rivets.

The brake member preferably has a casing surface which has perforations, thus advantageously achieving the effect of the brake member being of resilient design. The resilience of the brake member makes it possible for a tilting of the brake member to be avoided during the insertion into the housing half and for the brake member to be inserted in the desired axial direction.

The housing advantageously has two fastening holes which are aligned transversely with respect to a bearing plane of the housing, the fastening holes being arranged on both sides of the two main planes of the housing, which main planes are perpendicular with respect to the bearing plane, thus achieving a secure fastening of the housing. It is furthermore made possible for the two fastening holes to advantageously be arranged next to the brake members, thus advantageously reducing the overall height of the housing.

A guide section is provided on the housing, which guide section protrudes over a bearing plane of the housing with the door assembly part—the door or door pillar—and can be secured in a form-fitting manner to the corresponding door assembly part. This makes it possible for the door arrester to be easily attached to the door assembly part, since an unambiguous alignment of the door arrester with respect to the door assembly part is predetermined by the protrusion of the guide section. It is furthermore avoided as a result that the door assembly part and the door arrester are at a distance from each other, the door arrester thus being arranged in a space-saving manner on the door assembly part and not being negatively conspicuous visually to a user of the door or the retaining rod being perceived as annoying.

The guide section preferably has ribs which expediently bound the edge of the opening of the housing, and which have a progressively designed groove. The effect achieved by this is that, when the housing of the door arrester is attached, the orientation of the housing with respect to the door assembly part is predetermined by means of the groove. This ensures that the housing is attached in the desired manner.

The effect achieved by the expedient arrangement in each case of a rib on one of the two housing halves is that the fastening forces between the housing and the door assembly part are distributed uniformly to the two housing halves, therefore a secure attachment of the door arrester is ensured. Furthermore, a tilting or an oblique attachment is avoided.

In order to ensure a secure attachment of the door arrester, a hole for screws is preferably provided on each of the two housing halves and are provided for fastening the door arrester. The fastening provided by means of screws may be regarded as an alternative possibility of fastening the door arrester, or else as an additional fastening assisting the fastening by means of the guide sections. In the case of an additional fastening, the housing is first of all attached to the door assembly part by means of the guide sections in order then to be supplementarily fastened by means of the screws.

A cut surface which is aligned perpendicularly with respect to the direction of extent of the retaining rod is preferably provided in each case on the two housing halves. The two housing halves are advantageously connected to each other at the cut surfaces. The cut surfaces define an unambiguous connecting plane for the two housing halves, as a result of which erroneous assembly of the two housing halves is avoided. The assembly is advantageously facilitated by aligning and guide elements on the cut surfaces, with one aligning element expediently being assigned to one guide element.

In order to make the manufacturing and the production of the door arrester more effective, the two housing halves are advantageously of identical design. A single production line is therefore required and a large series length achieved.

The two housing halves are preferably produced from plastic as injection-molded parts, with a metallic thread for the screws advantageously being injected at the same time into the holes, as a result of which a complex subsequent fitting of the screw is omitted.

By means of a method for producing a door arrester having a housing designed in two parts, in which a first housing half and a second housing half bound just one section of an opening passed through by a retaining rod and a brake member is provided in at least one of the two housing halves, a simple and secure assembly is achieved by the fact that the two housing halves are connected only after the insertion of the retaining rod while prestressing means for the brake member are prestressed by the retaining rod. The effect achieved by this is that the insertion of the retaining rod and the prestressing of the brake members take place in a single working step. The effect furthermore achieved is that the door arrester can be preassembled in a single part and is then fastened on the designated door assembly part.

In one advantageous development of the method, the brake member is prestressed in one of the two housing halves in the direction of the retaining rod by a spring element which forms the prestressing means. Both the spring element and the brake member are inserted into the particular housing half before the connection of the two housing halves. The effect achieved by this is that, when the door arrester is assembled, an additional retention of the brake member during the insertion of the retaining rod is avoided, since both the brake member and the spring element are retained solely by the housing half. In addition, this predetermines the alignment of the brake member with the retaining rod in the desired manner and a possible tilting of the brake member and/or of the spring element caused by the insertion of the retaining rod is advantageously avoided.

A method for attaching a door arrester, in which a first housing half and a second housing half are connected to either the door or door frame only after the retaining rod is inserted, and in which the cut surfaces are aligned during the connection perpendicularly with respect to either the door or door frame, permits a simple installation by virtue of attachment to either the door frame or the door taking place after the retaining rod is inserted, with the cut surfaces of the two housing halves advantageously being aligned perpendicularly with respect to the door or the door frame. The perpendicular arrangement of the cut surfaces defines an unambiguous position of the housing during the attachment with respect to the motor vehicle, as a result of which the alignment can be checked at any time and it is ensured that the housing is fastened in the desired position.

In one preferred development of the method, the housing is connected to either the door or door frame by means of a rotational movement, with a bayonet connection preferably being provided. This avoids a complex fastening operation, since the bayonet connection enables the two parts to be connected by means of a single rotation.

BRIEF DESCRIPTION OF THE DRAWINGS

The invention is explained in more detail below using preferred exemplary embodiments of a door arrester according to the invention with reference to the attached drawings.

DETAILED DESCRIPTION

Figure 1:
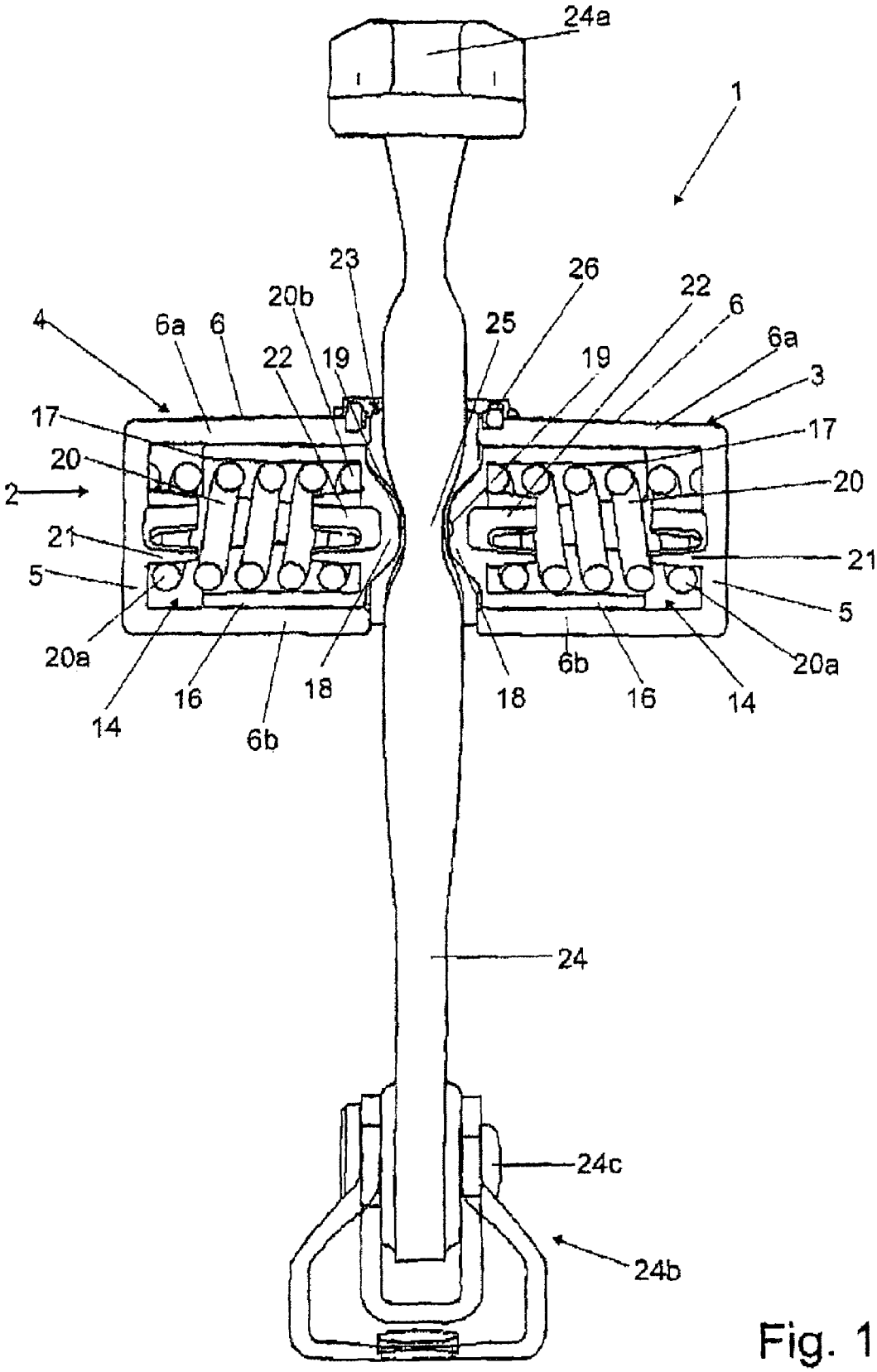
FIG. 1 shows a cross section through a preferred exemplary embodiment of a door arrester according to the invention.
Figure 3:
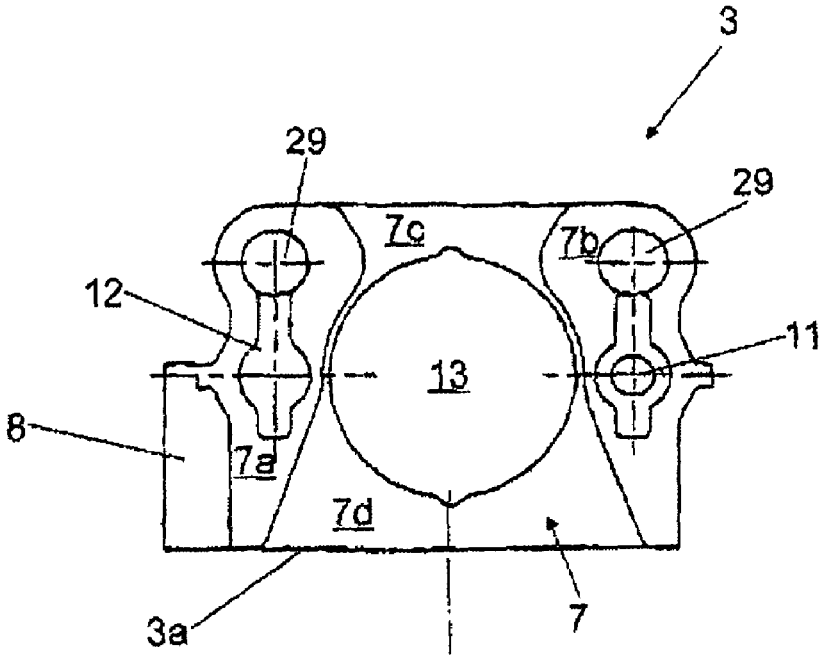
FIG. 3 shows a front view of the housing half from FIG. 2.
Figure 2:
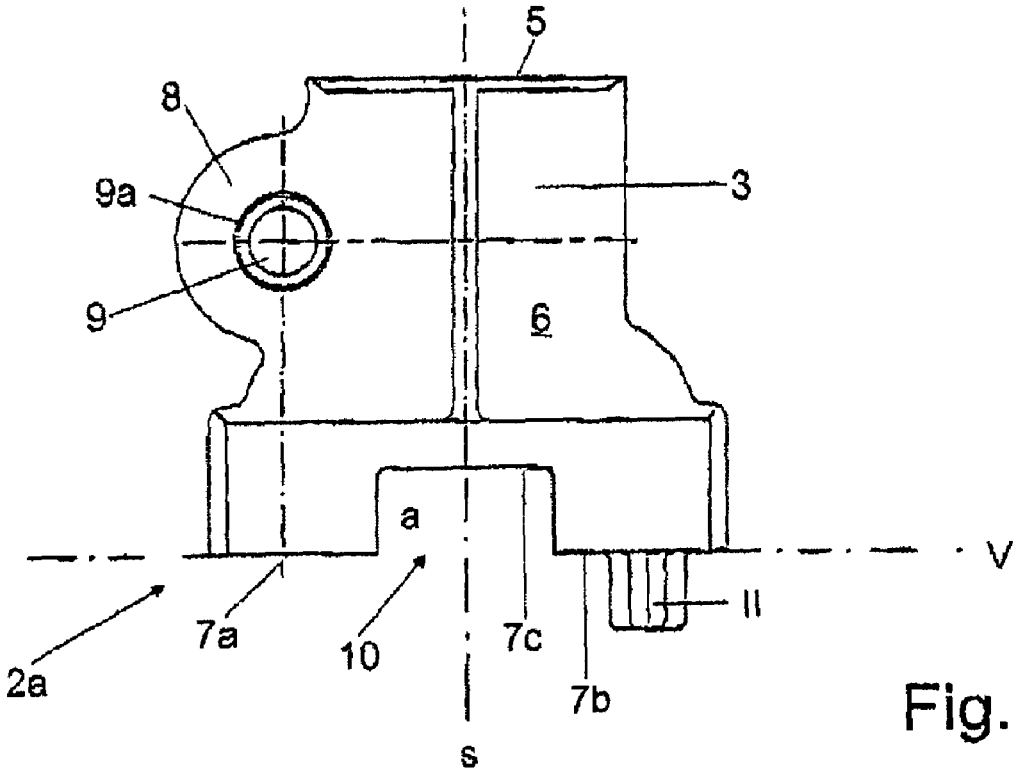
FIG. 2 shows a plan view of a housing half of the housing of the door arrester from FIG. 1.
Figure 4:
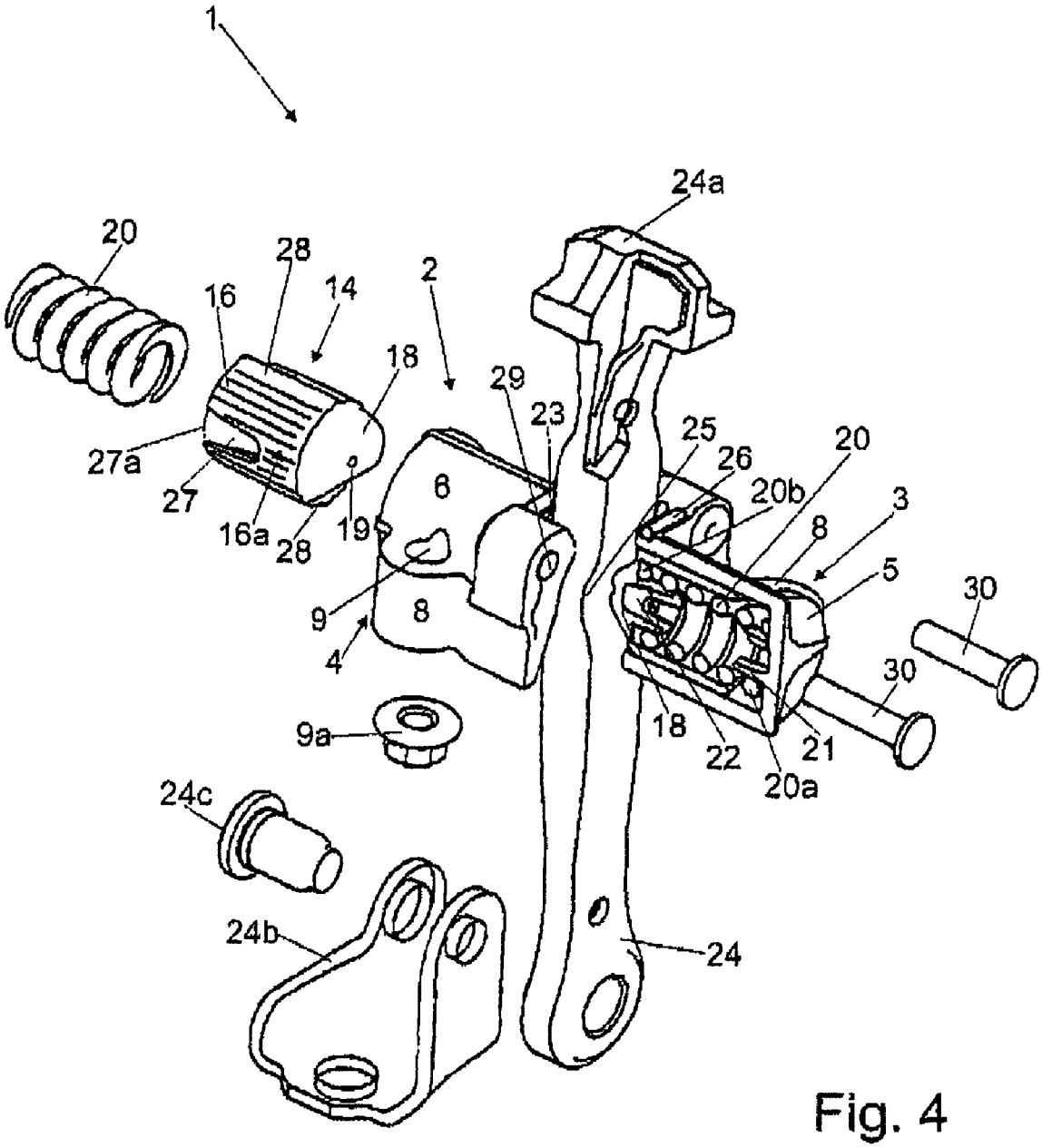
FIG. 4 shows an exploded illustration of the door arrester from FIG. 1.

FIGS. 1 to 4 show a first exemplary embodiment of a door arrester 1, in which a housing 2 which can be fastened on one of the door assembly parts—the door or door frame—has an opening 23 with a rectangular cross section which is passed through by a retaining rod 24 arranged on the other of the door assembly parts. Brake members 14 which are accommodated in the housing 2 and are prestressed axially in the direction of the rectangular opening 23 act upon the retaining rod 24, in which case, owing to latching recesses 25 formed in at least one of the two flat sides of the retaining rod 24, the brake members penetrate into a latching recess 25 or are pressed back therefrom, depending on the position of the retaining rod 24. The housing 2 is placed against the door assembly part along a bearing plane 3*a*.

The housing 2 comprises a first housing half 3 and a second housing half 4 which have an identical design, so the construction of the first housing half 3 will first of all be described by way of example for both housing halves 3, 4, with the second housing half 4 being of corresponding design and being provided with reference numbers.

The housing half 3 is designed as a hollow cylinder which is open at one end, comprising a closed base side 5 facing away from the opening 23, a casing 6 and a front side 7 which comprises a circular release opening 13 of the hollow cylinder, the circular release opening 13 merging into the polygonal opening 23 transversely with respect thereto.

The front side 7 comprises a first edge 7*a*, a second edge 7*b*, a third edge 7*c* and a fourth edge 7*d* which bound the circular release opening 13 of the housing half 3. The first and the second edges 7*a*, 7*b* and the third and the fourth edges 7*c*, 7*d* are arranged opposite each other in pairs. The first and the second edges 7*a*, 7*b* protrude by a distance a in relation to the third and the fourth edges 7*c*, 7*d*. A rectangular gap 10 is produced which is arranged in a central region of the front side 7 and is aligned symmetrically with respect to an axis S symmetrically dividing the front side 7 (cf. FIG. 2). The third and the fourth edges 7*c*, 7*d* are aligned with the circular release opening 13 of the housing half 3 whereas, by contrast, the first and the second edges 7*a*, 7*b* protrude by the distance a.

An aligning element 11 which is designed as a projection is arranged in the second edge 7*b*. A guide element 12 designed as a recess is provided in the first edge 7*a* (cf. FIG. 3). When the two housing halves 3, 4 are assembled, the aligning element 11 or guide element 12 of the first housing half 3 is brought into engagement with the guide element 12 or aligning element 11 of the second housing half 4, so that the two housing halves 3, 4 can be oriented in the desired alignment with respect to each other and can be axially plugged together.

Furthermore, in the two edges 7*a*, 7*b* in an upper half, a respective hole 29 passing through these edges parallel to the hollow cylinder is provided. In order to connect the two housing halves 3, 4, a rivet 30 is introduced into the holes 29 and secured.

On the side facing away from the bearing plane 3*a*, a damping strip 26 of soft plastic which is arranged above the outer surface formed by the casing 6 is fitted transversely with respect to the holes 29 along two opposite circumferential regions of the opening 23.

A projection 8 which is and has a semicircular profile (cf. FIG. 2) is arranged approximately over half of the height of the casing 6 integrally with the casing 6, approximately in the center of its extent and adjacent on one side to and laterally offset from the axis S.

In the projection 8, a hole 9 is formed perpendicularly with respect to the bearing plane 3*a*, the lateral arrangement of the projection 8 meaning that the hole 9 does not penetrate into the cavity of the housing half 3 or support it from below. The hole 9 ends flush with a flat side 3*a* of the housing half 3, which side forms a bearing plane for the housing 2 with the door or the door frame.

A metallic threaded component 9*a* is arranged within the hole 9 and is provided for the fastening of the housing half 3 by means of screws. The projection 8 extends approximately over that half of the overall height of the housing half 3 which faces the flat side 3*a*, with the hole 29 for the rivets 30 being arranged in the other half.

FIG. 1 shows a cross section of the door arrester 1, the housing half 3 having a U-shaped cross section. In this case, the base side 5 forms the base of the U and the two limbs 6*a*, 6*b* of the U are formed from cuts in the casing 6.

A brake member 14 is inserted through the circular release opening 13 into the hollow cylinder formed in the housing half 3, the brake member being guided axially in said hollow cylinder and having a shorter extent than the depth of the hollow cylinder, so that an axial displacement of the brake member 14 within the housing half 3 is possible.

The brake member 14, which is produced as a hollow part from plastic by injection molding, comprises a front end side 15, a casing surface 16 and a rear side 17 which faces away from the front end side and has a central access bounded by the casing surface. In the interior of the brake member 14, the casing surface 16 bounds an inner space of hollow-cylindrical design.

Figure 5:
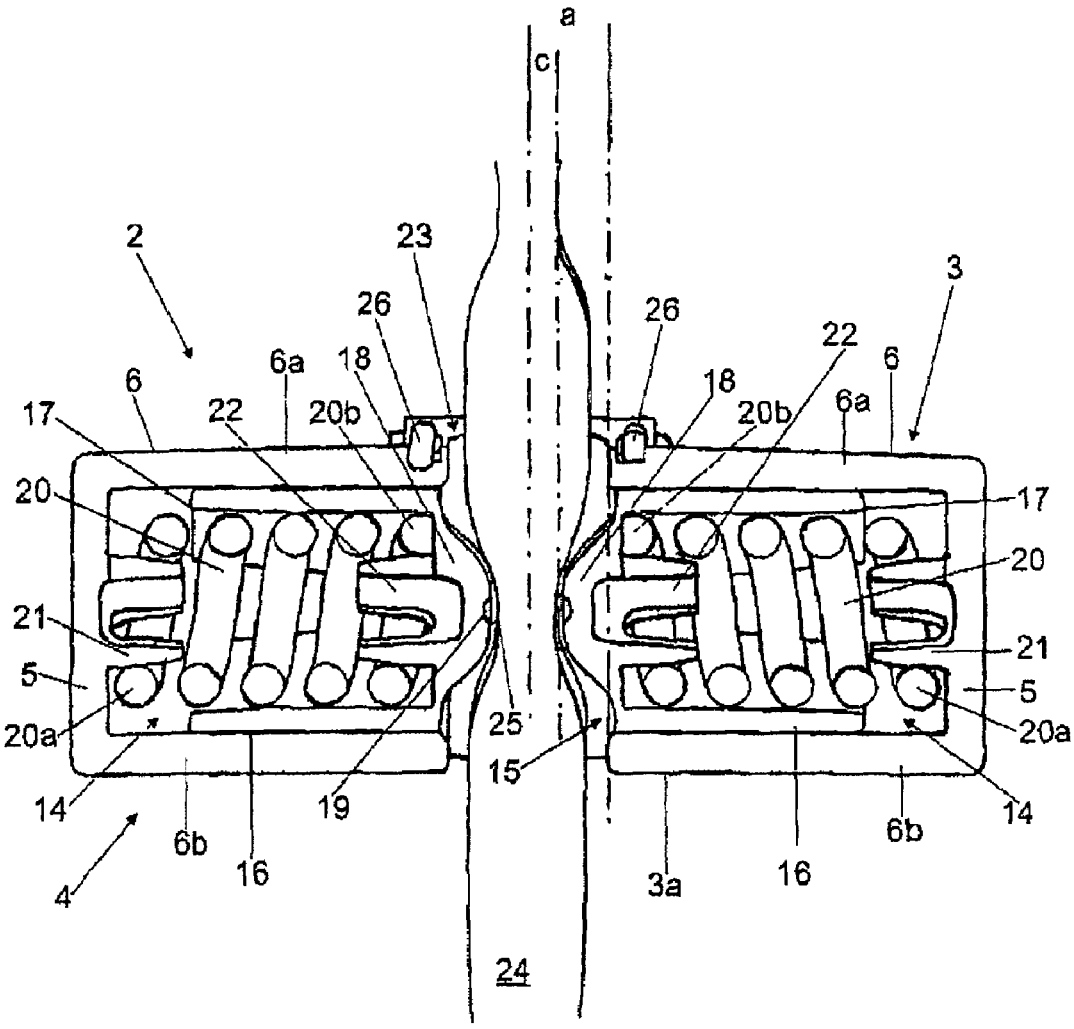
FIG. 5 shows an enlargement of a detail of the housing of the door arrester from FIG. 2.

The front end side 15 is designed with an engagement lug 18 which extends transversely with respect to the casing surface 16 over the diameter of the brake member 14 and is of rounded design in cross section (FIG. 5) and is of long stretched-out design along its extent in longitudinal section. The engagement lug 18 is formed essentially complementarily to latching recesses 25 which are aligned in the retaining rod 24, essentially transversely with respect to its direction of movement through the opening 23 defined in the housing 2.

The engagement lug 18 is dimensioned in such a manner that the first and second edges 7*a*, 7*b*, which protrude out of the front side 7 of the housing half 3 by a distance a, protrude further by a distance c, which is smaller in terms of amount than the distance a, than a frontmost edge of the engagement lug 18 of the brake member 14.

That surface region of the front end side 15 which faces the inner space has a central ring 22 which is aligned coaxially with the brake member 14, and an inner radial support for a spring element 20 which is designed as a helical spring which is supported on that surface region of the front end side 15 which faces the inner space, with a first end 20*a* against the base side 5 of the housing half 3 and with a second end 20*b* axially against the annular section bounded by the ring 22 and casing surface 16, and is radially surrounded at least in its proximal region by the casing surface 16. The force exerted on the brake member 14 by the spring element 20 presses the end side 15 of said brake member forward in the direction of the retaining rod 24, with the spring element 20 being pushed back and stressed in accordance with the position of the latching recesses 25 by the actuation of the vehicle door. On the inner end side of the base 5, a ring 21 is likewise arranged coaxially with the ring 22, which ring centers the helical spring 20 and guides it radially from the inside and also axially over the extent of the ring 21.

The casing surface 16 has three perforations which extend axially along the brake member 14 starting from the rear side and are designed as cutouts 27 (cf. FIG. 4), the cutouts 27 being arranged along the circumference of the casing surface 16 in such a manner that in each case two adjacent cutouts 27 are offset with respect to each other by an angle of 120°.

The cutouts 27 extend approximately over half of the length of the brake member 14. In the open rear side 17 of the brake member 14, regions 27*a* which remain of the cutouts 27 are cut free. In a region facing the end side 15 of the brake member 14, the cutouts 27 have a rounded region, the cutout 27 widening in profile from the rounded region to the rear side 17. The cutouts 27 enable the brake member 14 to be expediently of resilient or flexible design, with the result that, if the brake member 14 tilts, the force acting on the brake member 14 from the retaining rod 24 because of the movement of the door can deform said brake member a little and it can then move back into an actuable position.

The casing surface 16 has, on the outside, an axially extending, outer guide fluting 16 of respectively rounded grooves and ribs which are provided in an alternating manner, which guide fluting engages with an inner guide fluting of complementary design in the hollow cylinder of the housing half 3 and in such a manner defines a linear guide for the brake member 14, with the materials of the corresponding parts being optimized in respect of the sliding contact.

Furthermore, along the axial extent of the casing surface 16 of the brake member 14, two ribs which are raised in relation to the guide fluting are provided offset opposite each other by 180°, which ribs interact with corresponding, depressed grooves 28*a* formed axially in the casing 6 of the housing half 3, 4 (cf. FIG. 5) and therefore define a means of securing against rotation 28 in order to ensure a positionally correct installation of the brake members 14 in the corresponding housing part 3, 4.

The length of the brake member 14 is shorter than the depth of the hollow cylinder, so that the rear side 17 is always at a distance b from the base side 5 of the housing half 3, by which distance the brake member 14 can be displaced within the housing half 3, compressing the spring element 20.

When the spring element 20 is relaxed, a proximal region of the casing surface 16, in relation to which the engagement lug 18 protrudes, is aligned approximately with the circular release opening 13 of the hollow cylinder.

The door arrester 1 comprises two identical housing halves 3, 4 which are connected to each other with the respective front side 7 facing each other, the first and second protruding edges 7*a*, 7*b* of the two housing halves 3, 4 being in contact with each other in a flush manner and defining a cut surface 2*a* for each of the two housing halves 3, 4. The two cut surfaces 2*a* define a connecting plane V for the housing 2 (cf. FIG. 2), the two housing halves 3, 4 being connected to each other symmetrically with respect to the connecting plane V; in particular, the two housing halves 3, 4 each have a brake member 14.

The respectively defined gap 10 of the two housing halves 3, 4 is supplementary to the opening 23 for the retaining rod 24. The opening 23 has a rectangular shape and is bounded by the individual edges 7*a*, 7*b*, 7*c* and 7*d* supplementary to a boundary for the opening 23, the edges 7*a*, 7*b*, 7*c*, 7*d* of the individual housing halves 3, 4—as seen as a constructional unit—in each case bounding just one section, in the present half, of the opening 23 of the housing 2.

The opening 23 of the housing 2 is passed through by a central region of a retaining rod 24. The retaining rod 24 has a rectangular outer profile and is formed as a solid part, for example of hard rubber with a metal core or the like. The retaining rod 24 has essentially a width which is greater than twice the distance c of the brake member 14 from the first and second edges 7*a*, 7*b*, with an intermediate region with respect to the axially opposite brake members 14 being defined by the distances c. The dimensions of the opening 23 are matched to the dimensions of the central region of the retaining rod 24 and are smaller than end regions 24*a*, 24*b* which are provided for the pivotable fastening of the retaining rod 24 on the particular door assembly part and as an initial and final deflection for the door opening, an end region 24*b* being arranged pivotably on the retaining rod 24 by means of a bolt 24*c*.

Two latching recesses 25 are provided in the outer circumference of the retaining rod 24, which recesses are designed as curvatures in the retaining rod 24, one latching recess 25 being arranged in each case on one side of the retaining rod 24. The shape of the curvatures is matched to the profile of the bead of the engagement lugs 18 arranged on the brake members 14. The brake members 14 are prestressed in the direction of the retaining rod 24 by the compression springs 20 and are in frictional contact with the latching recesses 25 of the retaining rod 24. The latching recesses 25 define a preferred securing position for the door. It goes without saying that a plurality of latching recesses 25 which define a plurality of preferred immobilization positions for the door can be arranged on the retaining rod 24.

When the door is opened, the retaining rod 24 is displaced through the opening 23 of the housing 2, the brake members 14 which are prestressed by the compression springs 20 being displaced into a rear region of the particular housing half 3, 4 and the frictional contact of the brake members 14 with the retaining rod 24 becoming a sliding contact, so that the retaining rod 24 can be guided without great effort through the opening of the housing 2. If the movement of the door is stopped, the sliding contact again becomes a frictional contact and the brake members 14 latch in one of the latching recesses 25 of the retaining rod 24, the two brake members 14 acting upon the retaining rod 24 on both sides at the latching recesses 25 with the force imparted by the compression spring 20 and fixing it and therefore securely immobilizing the door.

During the assembly of the door arrester 1, first of all the two brake members 14 are inserted into the two housing halves 3, 4 with compression springs 20 inserted into the cavity. The retaining rod 24 is then brought between the two housing halves 3, 4 in such a manner that the central region of the retaining rod 24 is engaged around by the opening 23 of the housing 2. During the connection of the two housing halves 3, 4 by means of the rivets 30, the aligning elements 11 are brought into engagement in a matching manner with the guide elements 12 in order to obtain the desired alignment of the two housing halves 3, 4 with respect to each other.

The two housing halves 3, 4 are connected to each other by the two rivets 30 at the protruding edges 7*a*, 7*b* along the connecting plane V defined by the cut surfaces 2*a*. The brake members 14 come into contact with the retaining rod 24, since the distance between the two brake members 14 corresponds to twice the distance c and the width of the retaining rod 24 is greater. As a result, the brake members 14 are displaced at the same time in the housing halves 3, 4 counter to the direction in which the force of the compression springs 20 acts, with the brake members 14 therefore prestressed in the direction of the retaining rod 24 by the compression springs 20. The door arrester 1 can then be attached to the motor vehicle by means of screws in the holes 9.

Figure 6:
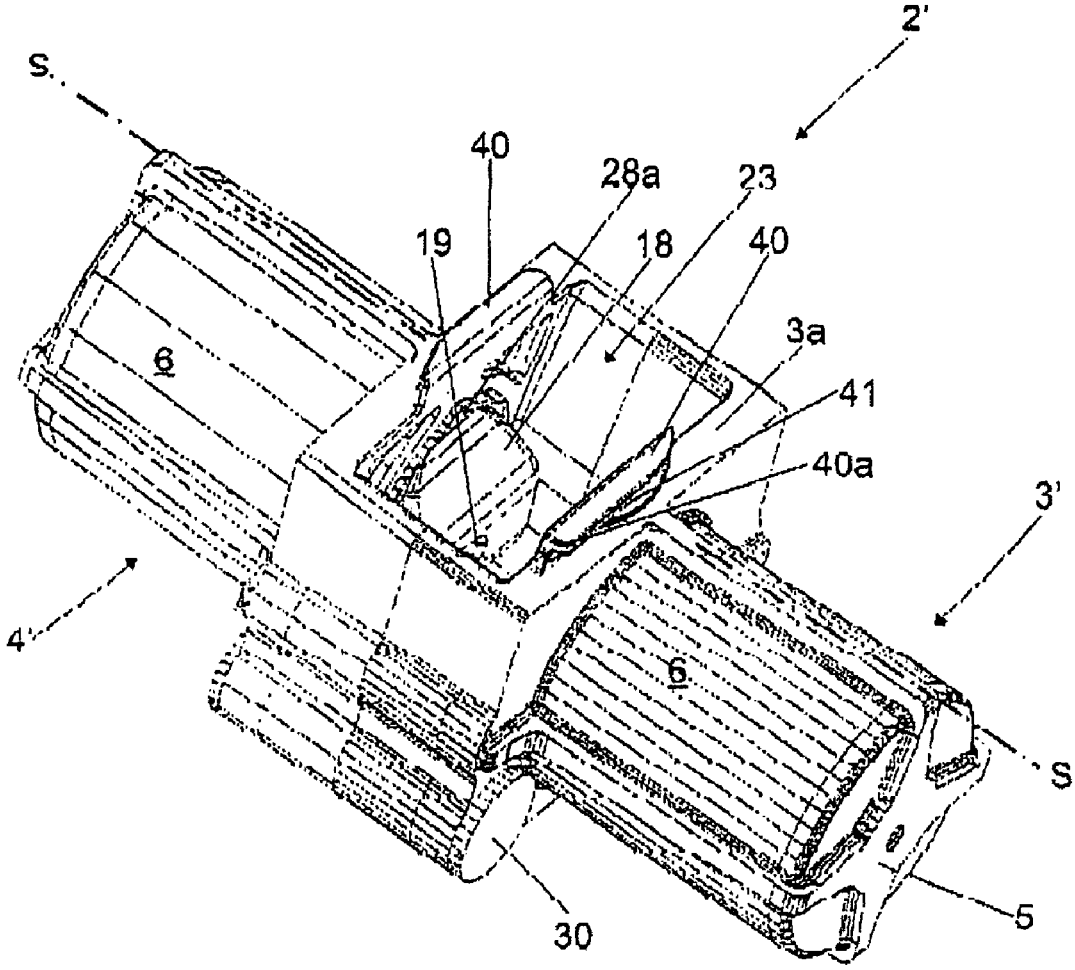
FIG. 6 shows a second exemplary embodiment of a door arrester according to the invention.

FIG. 6 shows a second exemplary embodiment of a door arrester 1'. The same reference numbers as in the first exemplary embodiment refer to the same or structurally comparable parts. Since the manner of operation of both exemplary embodiments of the invention is comparable, it is essentially the differences between the two exemplary embodiments which will be discussed below.

In contrast to the exemplary embodiment shown in FIGS. 1 to 4, the housing halves 3', 4' which are shown in FIG. 6 and form a housing 2' do not have holes 9 for the fastening of the housing 2'. On the contrary, two guide sections 40 are provided which are aligned perpendicularly with respect to the edges 7*a* of the two housing halves 3', 4'. The guide sections 40 are aligned with the particular front side 7 of the housing halves 3', 4'. The guide section 40 is offset laterally with respect to the axis of symmetry S of the first housing half 3' in the direction of the edge 7*b*.

The guide section 40 has a rib 40*a* and a groove 41. The groove 41 runs parallel to the front side 7 of the housing half 3' at a distance, the distance increasing in profile from the edge 7*a* in the direction of the edge 7*b*. The groove 41 is of progressive design.

In contrast to the first exemplary embodiment, the door arrester 1' is now attached to the motor vehicle as follows. In the region provided for the fastening of the door arrester 1' the motor vehicle has an aperture, the dimensions of the aperture corresponding to the dimensions of the opening 23 of the housing 2'. The door arrester 1' is guided on the aperture, with the grooves 41 at the smallest distance from the front side 7 bearing against the aperture. The grooves 41 can be inserted into the aperture of the motor vehicle. The door arrester 1' is then rotated in the clockwise direction and the grooves 41 which are of progressive design and the edge of the aperture of the motor vehicle form a nonpositive connection, with the ribs 40*a* being guided within the opening.

As an alternative, it would also be possible to arrange the progressivity of the groove 41 in the reverse direction, the distance decreasing in profile from the edge 7*a* in the direction of the edge 7*b*. In order to fasten the door arrester 1', after it has been inserted into the aperture of the motor vehicle, a rotation counterclockwise is then required.

It goes without saying that both exemplary embodiments described above can be combined in such a manner that the door arrester is first of all connected to the motor vehicle by means of the rotational movement and is then further securely fastened by means of the screws which are arranged in holes provided on the housing halves.

What is claimed is:

1. A door arrester, comprising a housing which can be fastened on one of a door and a door frame, the housing including an opening and a bearing plane, the housing including further two main planes being orthogonal with respect to the bearing plane, a retaining rod passing through said opening of the housing, wherein the retaining rod can be fastened pivotably on the other of the door and the door frame, at least one brake member being prestressed in a direction towards the retaining rod, the brake member having a casing surface and being held at the casing surface in an axially displaceable manner in the housing, and at least two fastening holes arranged perpendicularly with respect to the bearing plane of the housing, wherein a first one of the at least two fastening holes is arranged on a first side of each of the two main planes of the housing and a second one of the at least two fastening holes is arranged on a second side of each of the two main planes of the housing.

2. The door arrester as claimed in claim 1, wherein the housing includes an axis running perpendicularly with respect to the retaining rod, and wherein the at least two fastening holes have a connecting line forming an angle with the axis of the housing.

3. The door arrester as claimed in claim 1, further including threads in the fastening holes.

4. The door arrester as claimed in claim 3, wherein the threads are formed by metallic threaded components.

5. The door arrester as claimed in claim 4, wherein the threaded components only partially fill the fastening holes.

6. The door arrester as claimed in claim 1, wherein the fastening holes are offset with respect to the brake member.

7. The door arrester as claimed in claim 1, wherein the housing has a height extending at least above the fastening holes.

8. The door arrester as claimed in claim 1, wherein each of the at least two fastening hole defines an axis which is aligned perpendicularly with respect to the brake member.

9. The door arrester as claimed in claim 1, comprising two brake members which are arranged symmetrically with respect to the opening in the housing.

10. The door arrester as claimed in claim 1, wherein the at least two fastening holes are produced integrally with the housing by injection molding, with a first one of the fastening holes being offset in relation to an area of the housing which receives the brake member.

11. The door arrester as claimed in claim 1, wherein the housing includes an outer bearing surface and wherein the bearing plane is formed by the outer bearing surface.

12. The door arrester as claimed in claim 11, wherein the fastening holes end flush with the bearing surface of the housing.

13. The door arrester as claimed in claim 1, further comprising a riveted joint stiffening the opening of the housing, and wherein the end side of the fastening hole furthest away from the bearing plane is below the riveted joint.

14. The door arrester as claimed in claims 1, further comprising screws being provided in the fastening holes to fasten the housing.

15. The door arrester as claimed in claim 14, wherein the screws are self-furrowing screws.

16. The door arrester as claimed in claim 1, wherein the housing includes a first housing half and a second housing half which are connectable to each other, wherein the first housing half and the second housing half each bound a respective portion of the circumference of the opening, and wherein the brake member, which is prestressed in the direction of the retaining rod by a spring element, is arranged in at least one of the first housing half and the second housing half.

17. The door arrester as claimed in claim 16, wherein the retaining rod is fixed in the opening by the brake member when the door is not moving, the brake member acting upon a wide side of the retaining rod.

18. The door arrester as claimed in claim 17, wherein the brake member is arranged such that it can be adjusted perpendicularly with respect to said wide side of the retaining rod.

19. The door arrester as claimed in claim 18, wherein the brake member has a front end side facing the retaining rod, and wherein said end side has an engagement lug running transversely with respect to the direction of movement of the retaining rod.

20. The door arrester as claimed in claim 16, wherein a respective brake member is provided in the first housing half and in the second housing half, and wherein the front end sides of the two respective brake members face each other.

21. The door arrester as claimed in claim 16, wherein the spring element comprises a compression spring, and wherein the compression spring is at least partially arranged within the brake member.

22. The door arrester as claimed in claim 16, wherein the opening is smaller than both end regions of the retaining rod, and wherein the opening is larger than an intermediate region of the retaining rod.

23. The door arrester as claimed in claim 16, wherein the first housing half and the second housing half are connected to each other by rivets.

24. The door arrester as claimed in claim 16, wherein the two housing halves are injection-molded parts.

25. The door arrester as claimed in claim 16, wherein the brake member includes an end side facing away from the retaining rod, the end side having a central hole.

26. The door arrester as claimed in claim 16, wherein the casing surface has cutouts formed therein.

27. The door arrester as claimed in claim 16, wherein the casing surface has an opening, and the spring element is at least partially accommodated within the opening in the casing surface.

28. The door arrester as claimed in claim 16, wherein the spring element is a helical spring.

29. The door arrester as claimed in claim 26, wherein the cutouts of the casing surface are in an end side of the brake member facing away from the retaining rod.

30. The door arrester as claimed in claim 26, wherein the cutouts of the casing surface are provided as separate perforations.

31. The door arrester as claimed in claim 26, wherein the cutouts of the casing surface are designed as a recess in the brake member.

32. The door arrester as claimed in claim 31, wherein the cutouts have a rounded circumferential profile at least in some sections.

33. The door arrester as claimed in claim 16, further comprising an axially extending guide fluting being arranged on the casing surface of the brake member.

34. The door arrester as claimed in claim 16, further comprising, on the casing surface of the brake member, means for securing against rotation.

35. The door arrester as claimed in claim 16, further comprising an engagement lug arranged on said end side of the brake member facing the retaining rod.

36. The door arrester as claimed in claim 35, wherein the engagement lug has a bead formation aligned transversely with respect to an axis of the brake member.

37. The door arrester as claimed in claim 16, wherein the brake member is a plastic injection molded part.

38. The door arrester as claimed in claim 16, further comprising a second brake member, said two brake members being arranged in a mirror-inverted manner with respect to the retaining rod.

39. The door arrester as claimed in claim 1, further comprising at least one latching recess being arranged on the retaining rod.

40. The door arrester as claimed in claim 1, further comprising a guide section being provided on the housing, wherein the guide section protrudes over the bearing plane of the housing with either the door or door frame, and in that the guide section can be secured in a form-fitting manner on either the door or door frame.

41. The door arrester as claimed in claim 40, wherein the guide section has ribs.

42. The door arrester as claimed in claim 41, wherein the ribs provided on the housing bound the edge of the opening.

43. The door arrester as claimed in claim 41, wherein the ribs include a groove being of progressive design.

44. The door arrester as claimed in claim 40, wherein the housing has a first housing half and a second housing half, and wherein the respective guide sections are provided on the first housing half and on the second housing half.

45. The door arrester as claimed in claim 16, wherein the opening is smaller than both end regions of the retaining rod, and wherein the housing can be connected by an intermediate region of the retaining rod being fitted over in order to form the opening.

46. A door arrester, comprising:

a housing which can be fastened on one of a door and a door frame, the housing including an opening and a bearing plane, the housing including further two main planes being orthogonal with respect to the bearing plane, a retaining rod passing through said opening of the housing, wherein the retaining rod can be fastened pivotably on the other of the door and the door frame, at least one brake member being prestressed in a direction towards the retaining rod, the brake member having a casing surface and being held by the casing surface in an axially displaceable manner in the housing, and wherein the casing surface has cutouts formed therein.

47. A door arrester, comprising:

a housing which can be fastened on one of a door and a door frame, the housing including a first housing half, a second housing half and a connecting plane, the first housing half and the second housing half being connectable to each other along the connecting plane, the housing including an opening, wherein the first housing half and the second housing half each bound a respective portion of the circumference of the opening;

a retaining rod passing through said opening of the housing, wherein the retaining rod can be fastened pivotably on the other of the door and the door frame, a brake member being received in the first housing half and being prestressed in a direction towards the connecting plane and towards the retaining rod by a spring element being arranged in the first housing half.

* * * * *